US005671502A

United States Patent [19]

Ezman

[11] Patent Number: 5,671,502

[45] Date of Patent: Sep. 30, 1997

[54] ROLLER MECHANISM FOR A SLIDING DOOR

[76] Inventor: Lucian S. Ezman, ul. Tyszkiewicza, 35 m24, Warsaw, Poland

[21] Appl. No.: 654,713

[22] Filed: May 29, 1996

[51] Int. Cl.[6] ..... A47H 15/00; E05D 15/06

[52] U.S. Cl. ..... 16/105; 16/91; 49/425

[58] Field of Search ..... 16/99, 97, 105, 16/106, 107, 91; 49/425, 420, 410, 411; 160/105

[56] References Cited

U.S. PATENT DOCUMENTS

| | | | |
|---|---|---|---|
| 3,261,129 | 7/1966 | Brydolf | 16/105 |
| 3,298,136 | 1/1967 | Saunders | 49/425 |
| 3,526,995 | 9/1970 | Saunders | 49/420 |
| 3,670,357 | 6/1972 | Steigerwald | 16/105 |
| 3,750,337 | 8/1973 | Brydolf et al. | 49/411 |
| 3,956,854 | 5/1976 | Yamamoto | 49/425 |
| 4,134,178 | 1/1979 | Stevens | 16/100 |
| 4,193,500 | 3/1980 | Scott | 206/577 |
| 4,227,346 | 10/1980 | Kubik | 49/425 |
| 4,404,771 | 9/1983 | Murase et al. | 49/425 |
| 4,633,615 | 1/1987 | Moose | 49/425 |
| 4,811,683 | 3/1989 | Gephart | 16/97 |
| 4,850,145 | 7/1989 | McAfee | 49/501 |
| 4,873,741 | 10/1989 | Riegelman | 16/105 |
| 4,899,493 | 2/1990 | Baumgarten | 49/425 |
| 5,148,630 | 9/1992 | Llorens | 49/425 |
| 5,161,330 | 11/1992 | Auriemma | 49/420 |
| 5,349,783 | 9/1994 | Jasperson et al. | 16/105 |
| 5,598,606 | 2/1997 | Jacobs | 16/105 |

FOREIGN PATENT DOCUMENTS 0195721 9/1986 European Pat. Off. .

OTHER PUBLICATIONS

DSH Inc. Brochure Date Unknown Canada.
Sifisa Brochure Date Unknown France.
Sogal Brochure Date Unknown France.

*Primary Examiner*—Chuck Y. Mah
*Attorney, Agent, or Firm*—Smith Patent Office

[57] ABSTRACT

A roller mechanism for a sliding door that slides along a lower track. The roller mechanism includes a rigid bracket member so that it may be attached to a sliding door, a roller housing that contains a roller and that is vertically adjustable within the bracket member, and lower track engaging means that are releasably retained within the lower track. The lower track engaging means comprises a pair of leading and a pair of following track retainers. One of the leading and one of the following track retainers are rigid and capable of supporting the sliding door when the roller is removed from the lower track while the other of the leading and following track retainers are flexibly resilient such that they may be displaced to allow for the insertion and removal of the lower track engaging means into and out of the lower track.

17 Claims, 4 Drawing Sheets

ROLLER MECHANISM FOR A SLIDING DOOR

FIELD OF THE INVENTION

This invention relates to roller mechanisms for sliding doors, of the type having a door panel that slides along a lower track, and in particular to an improved form of roller mechanism having means to retain the door in its track.

BACKGROUND OF THE INVENTION

Sliding doors are commonly used in a wide variety of applications in both residential and commercial settings. For example, sliding doors are often used on wardrobes, cabinets, closets, display cases and as sliding partition doors. A typical sliding door is comprised of a single panel with appropriate framing hardware. In many cases door panels are formed from a thin sheet of hardboard or fibreboard and may be faced with a decorative covering or replaced with a mirror. The edges of the door panel are usually framed by top, bottom and side rails in order to form a rigid rectangular structure. A pair of hanging or guide rollers are typically attached to the two upper inside corners of the door panel with a pair of lower track rollers attached to the bottom inside corners of the panel. In some cases the rails framing the panel may be held together through the use of bolts or screws, while in other cases the housings which encase the upper guide rollers and lower track rollers serve a dual function and also act as means to hold the entire structure together.

A sliding door is normally held in position by first inserting the upper guide rollers into an upper channel or track mounted on the door frame, and then inserting the lower rollers into a track running along the floor. In order to prevent mis-alignment, and to stop the door from popping out of the lower track, a variety of different structures and types of lower roller mechanisms, having what is commonly referred to as "anti-jump" capabilities, have been utilized.

While some of these prior art devices have met with limited success, they all suffer from a number of inherent limitations. In many cases the so called anti-jump features of bottom roller mechanisms are secondary add-on parts that require additional installation, add significantly to cost, and, due to their complexity, are often left off by tradesmen. In other cases the anti-jump features, while proving to be relatively effective in preventing the rollers from unwantingly coming out of the lower track, tend to make removal of the door for purposes of maintenance or cleaning to be both difficult and time consuming.

A further inherent shortcoming associated with such prior art devices includes their inability to provide a rigid means to support the weight of the door when it has been removed from the lower track. Prior to the installation of a door, or if the door has been removed for purposes of maintenance or cleaning, it is very common to lean the door against a wall, resting it on its lower edge. In such cases, in order to avoid damaging the anti-jump mechanisms, the door often rests directly upon the rollers, thereby increasing the possibility of causing damage to the rollers or embedding dirt that will increase rolling resistance.

SUMMARY OF THE INVENTION

The present invention therefore provides a structure that overcomes these problems through the provision of a roller mechanism that incorporates a unique anti-jump feature that also provides a means to fully support the door when removed from its track.

Accordingly, in one of its aspects the invention provides a roller mechanism for a sliding door of the type having a door panel, a rectangular frame with rigid bottom, top and side members, and a lower track for receiving a roller, the roller mechanism comprising; (i) a rigid bracket member to attach said roller mechanism to said sliding door; (ii) a roller housing containing a roller, said roller housing being vertically adjustable within said bracket member, said roller being receivable within said lower track and facilitating the sliding movement of said door; and, (iii) lower track engaging means, said engaging means being releasably retained within said lower track and comprising a pair of leading and a pair of following track retainers, one of said leading and one of said following track retainers being rigid and capable of supporting said sliding door when said roller is removed from said lower track, the other of said leading and of said following track retainers being flexibly resilient such that they may be displaced to allow for the insertion and removal of said lower track engaging means into and out of said lower track.

In a further aspect the invention provides a roller mechanism wherein the sliding door is fully supported by only said leading and said following track retainers when the roller is removed from said lower track and said sliding door is stood on a surface, said roller not coming into contact with said surface when said door is fully supported by said leading and said following track retainers.

BRIEF DESCRIPTION OF THE DRAWINGS

For a better understanding of the present invention, and to show more clearly how it may be carried into effect, reference will now be made, by way of example, to the accompanying drawings which show the preferred embodiment of the present invention in which.

DESCRIPTION OF THE PREFERRED EMBODIMENT

Figure 1:
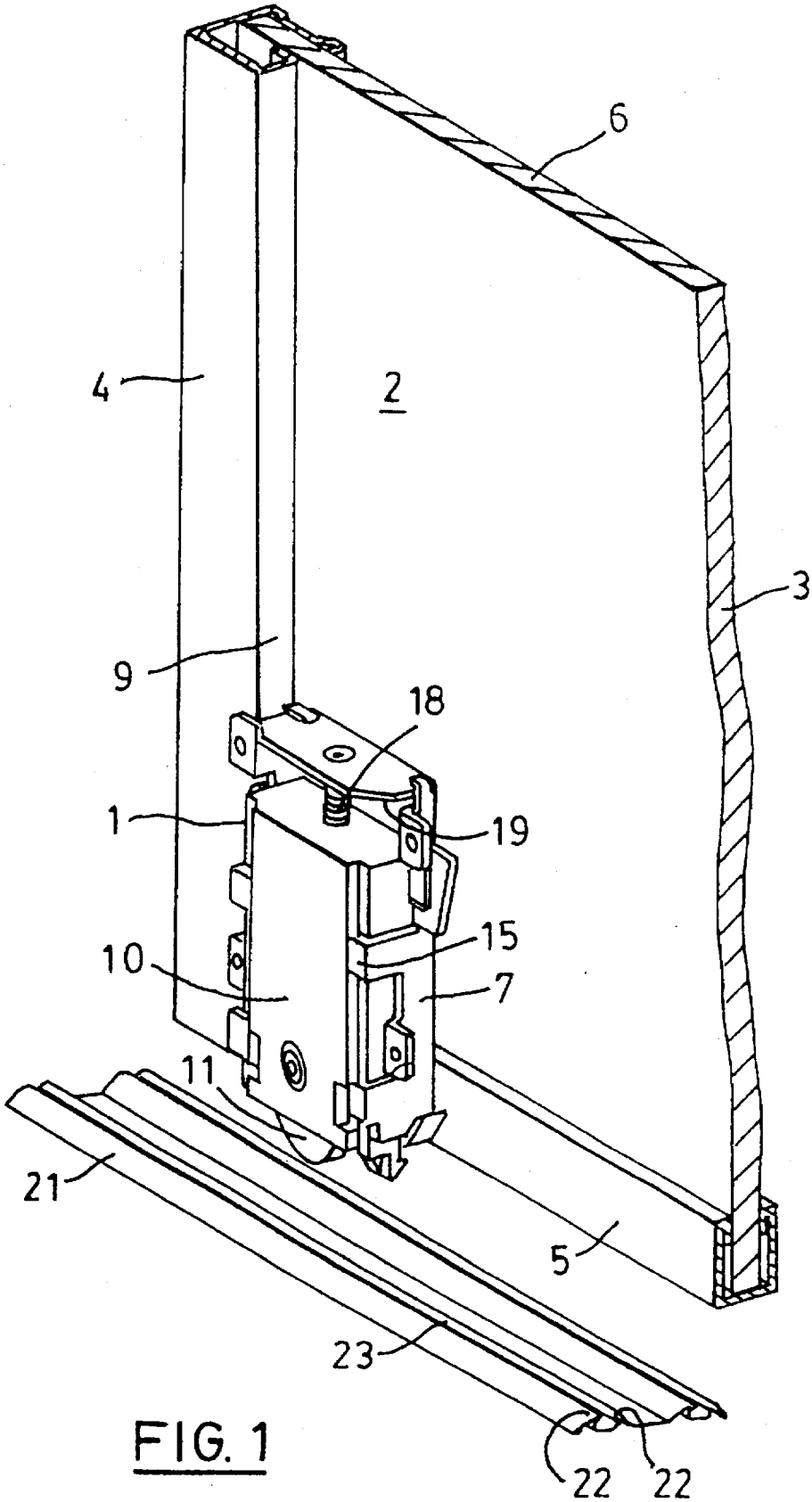
FIG. 1 is a fragmented view of the lower portion of a sliding door which includes the roller mechanism of the present invention.

Referring to the drawings, the roller mechanism according to the present invention is noted generally by the reference numeral 1. In FIG. 1, roller mechanism 1 is shown attached to a sliding door 2 that is comprised primarily of a door panel 3 fitted at its side edges with stiles or side members 4, at its lower edge with a lower or bottom member 5 and with a top framing member (not shown) along its upper edge. The top framing member, together with side and bottom members 4 and 5 respectively, form a rigid rectangular frame around door panel 3. The outer surface 6 of door panel 3 would typically be faced with a decorative covering or replaced with a mirror.

Figure 2:
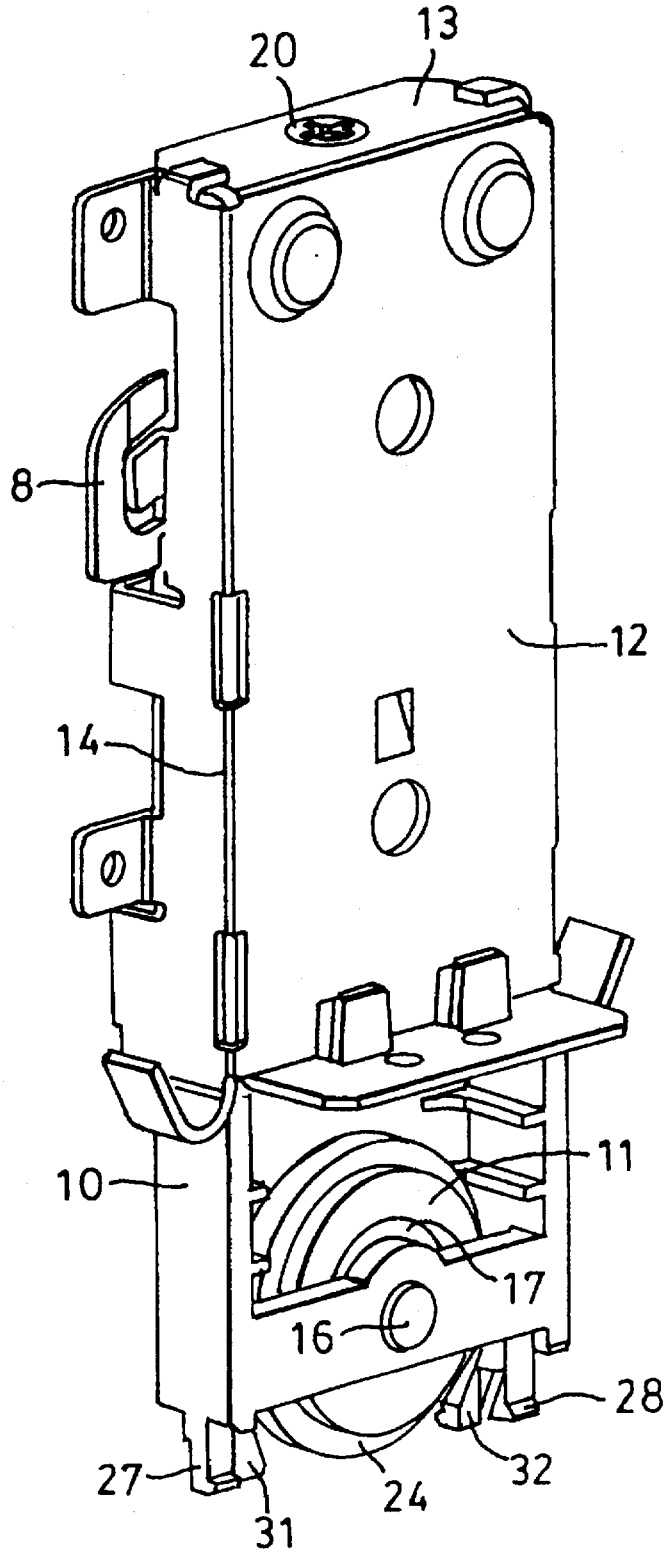
FIG. 2 is a rear detailed view of the roller mechanism of FIG. 1.

A roller mechanism pursuant to the present invention is positioned at each of the two lower corners of sliding door 2. In the preferred embodiment roller mechanism 1 includes a rigid bracket member 7 used to attach the mechanism to sliding door 2. As shown in FIGS. 1 and 2, bracket member 7 includes a plurality of outwardly extending ears 8 which engage slots 9 within stiles or side members 4 and bottom member 5. Ears 8 and slots 9 are constructed such that ears 8 essentially "snap" into slots 9 and form a means to connect or positively lock side member 4 and bottom member 5 together. The mechanical locking of the door frame members together at the lower corners in this fashion also effectively holds roller mechanism 1 in a stable and fixed position that is relatively parallel to sliding door 2.

While the use of ears 8 that are received within slots 9 has been described and shown in the accompanying drawings, it will be appreciated by those skilled in the art that side members 4 and bottom member 5 could also be fastened together in a variety of other manners, including through the use of bolts or screws. In such cases roller mechanism 1 would then typically be fastened by way of bolts or screws to side member 4 and bottom member 5 in order to secure it in a fixed and stable position.

Received within rigid bracket 7 is a roller housing 10 containing a roller 11. As is shown in FIGS. 1 and 2, rigid bracket 7 is a generally rectangular hollow body with an open bottom end that slidably receives roller housing 10 therein. Preferably, bracket 7 is comprised of metal for purposes of strength and would typically have enclosed back, side and top surfaces. Inwardly oriented retainer members 15 serve to retain roller housing 10 within bracket 7, without the need for an enclosed front surface on bracket 7. That is, through the use of inwardly oriented retainer members 15 the amount of metal necessary to manufacture bracket 7 is minimized (as is weight and cost) and a means is provided to access roller housing 10, if such should become necessary.

Figure 3:
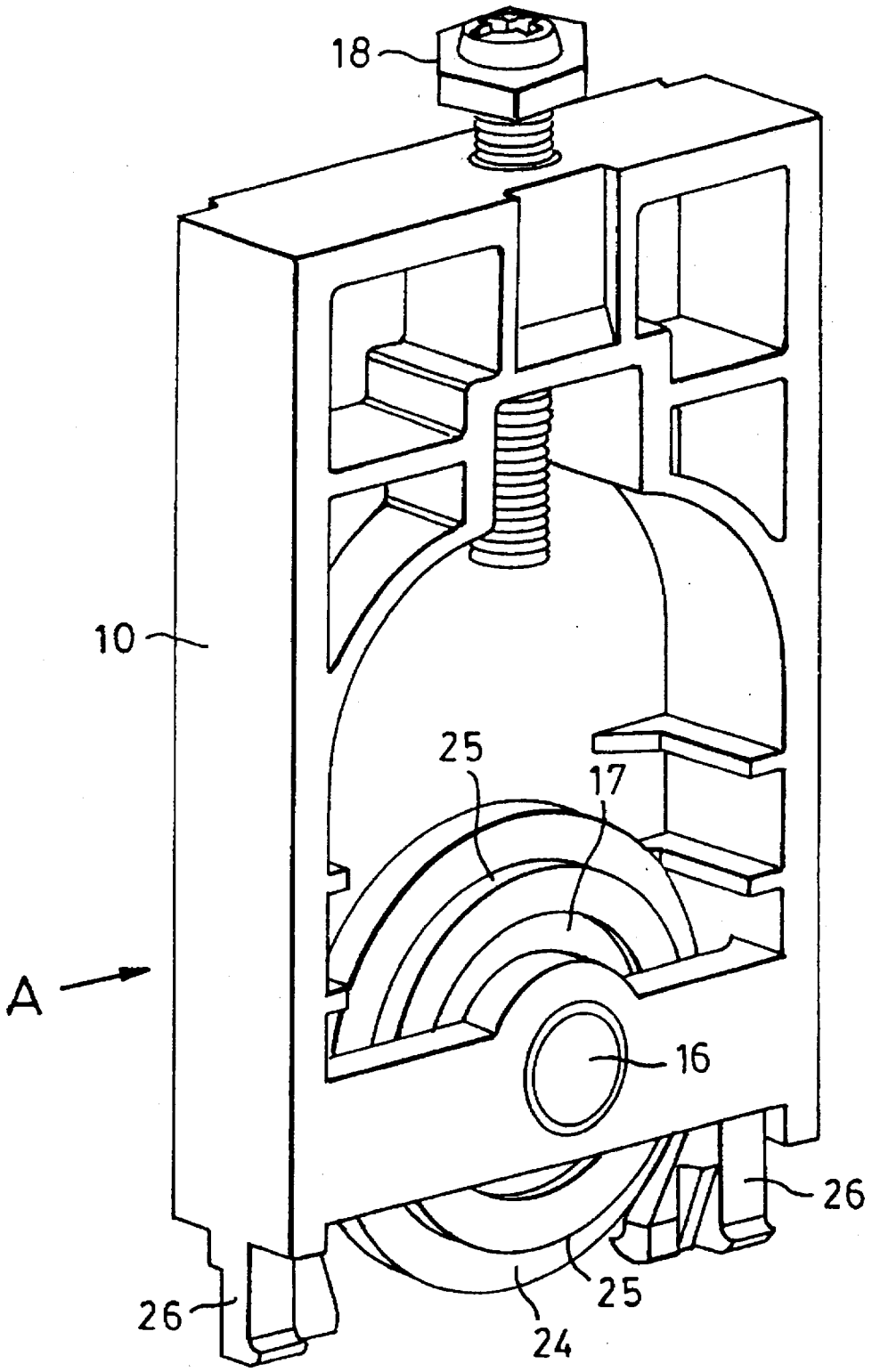
FIG. 3 is a rear detailed view of the roller housing of FIG. 2.

Referring to FIGS. 1, 2 and 3, it will be noted that roller 11 is positioned toward the bottom portion of roller housing 10. In the preferred embodiment, roller 11 is comprised of a relatively thin wheel member mounted in roller housing 10 such that its plane of revolution is parallel to bracket member 7. As discussed above, bracket member 7 is generally parallel to door panel 3. Accordingly, in this configuration roller 11 will also be generally parallel to door panel 3.

Roller 11 is mounted on an axle 16 that is supported at both ends by roller housing 10. Axle 16 passes through the centre of roller 11 and has each of its ends secured and embedded within the sides of roller housing 10. When in use the entire weight of sliding door 2 will normally bear upon rollers 11. Accordingly, by supporting axle 6 at each end the tendency of the axle to twist under the load of a heavy door is removed. Supporting axle 16 at each end removes any cantilevered loading that would occur if the axle were supported at only one end. This structure also allows uniform roller and axle deformation under heavy loading, thereby preventing the axis of the roller's rotation from being deflected.

Maintaining axle 16 perpendicular to the longitudinal axis of roller housing 10 in this manner ensures that the plane of revolution for roller 11 will remain parallel to door panel 3 and that the door will slide smoothly. In order to reduce friction and facilitate in the rotation of roller 11 about axle 16, bearing means 17 are utilized. However, it will be appreciated that, particularly for use in association with "light duty" doors, roller 11 may be mounted directly on axle 16 without the need for bearing means 17. Where bearing means 17 is used, it preferably comprises a set of encased roller bearings mounted about axle 16. As shown in FIG. 1, the outer surface of roller housing 10 is solid so as to help protect roller 11, and bearings 17, from damage that may occur during installation, handling, or operation. Axle 16 may be in the form of a rod, rivet or bolt.

While roller housing 11 is slidably retained within bracket 7, its vertical position is adjustable within bracket 7 through the use of an adjustment screw 18. Preferably adjustment screw 18 is threaded into the upper portion of roller housing 10 and has an enlarged head that bears against the lower surface 19 of top 13 of bracket member 7. While a variety of methods may be utilized to extend or retract adjustment screw 18 into or out of roller housing 10 (and thereby raising or lowering sliding door 2) preferably the top 13 of bracket member 7 contains a hole 20 which aligns with adjustment screw 18. A tool can then be inserted through top 13 to engage adjustment screw 18. Turning adjustment screw 18 will then have the effect of either moving roller 11 downwardly out of bracket 7 or retracting roller 11 up into bracket 7. In this manner door 2 can be raised or lowered. It will also be appreciated that adjustment screw 18 is retained wholly within bracket member 7 such that it is protected from damage during installation and handling and that it does not catch on items when the door is slid along its track.

With roller mechanism 1 secured onto sliding door 2, the door is ready to be set into place. A pair of upper guide or hanging rollers are first received within an upper track mounted in the doorway (not shown), following which roller 11 is placed within a lower track 21. Lower track 21 is comprised of a length of extruded material having a pair of upwardly and inwardly overturned lip members 22 which form a longitudinal channel 23 therebetween.

As shown in FIGS. 2 and 3, roller 11 includes a thin circumferential disc portion 24 and a pair of circumferential shoulder portions 25 positioned on either side of disc portion 24. When roller 11 is received within lower track 21 it is disc portion 24 that is received within channel 23. Shoulders 25 rest directly upon lip members 22 and support at least a portion of the weight of the door. This allows an even distribution of the door's weight upon each lip member 22, increases stability and reduces point loading that would otherwise occur if the entire weight of the door was carried on a smaller central portion of roller 11. Furthermore, through the receipt of disc portion 24 within channel 23, roller 11 is held securely within lower track 21 thereby stabilizing the door and preventing it from swinging inwardly or outwardly from lower track 21. It will also be understood by those familiar with the art that through tensioning adjustment screw 18, roller housing 10 can be vertically adjusted within bracket member 7 to help securely hold disc portion 24 within channel 23.

While the tensioning of adjustment screw 18 will serve to assist in maintaining roller 11 within lower track 21, roller mechanism 1 also includes lower track engaging means 26 to help maintain the alignment of roller 11 with lower track 21 and to also act as a further means to prevent roller 11 from "jumping" out of track 21. Lower track engaging means 26 are releasably retainable within channel 23 and comprise a pair of leading track retainers 27 and 31 and a pair of following track retainers 28 and 32. When these leading and following track retainers are releasably retained within channel 23, roller housing 1 0, and hence roller 11, is prevented from vertical movement out of lower track 21, regardless of the relative position of adjustment screw 18.

Figure 4:
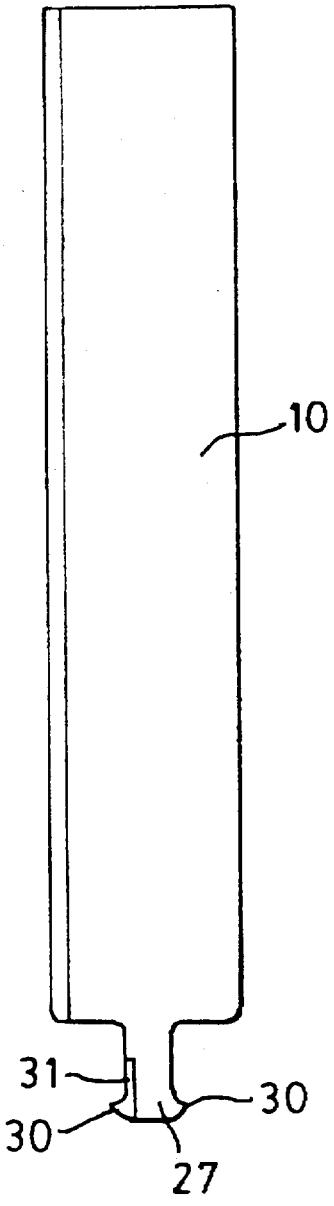
FIG. 4 is a side view of the roller housing of FIG. 3 as viewed from the direction "A"; and, FIG. 5 is a detailed view of the lower portion of the roller housing of FIG. 1.
Figure 5:
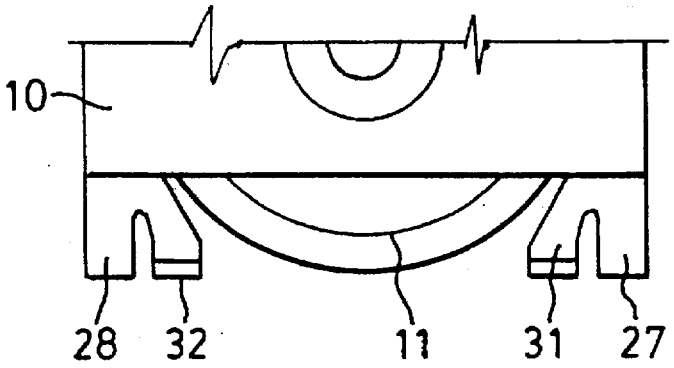

The particular structure of the leading and following track retainers is shown more clearly in FIGS. 4 and 5. Each of leading track retainers 27 and 31 and following track retainers 28 and 32 comprise a pair of downwardly projecting hook-like members having outwardly extending lugs 30 that engage lower track 21 beneath lip members 22. Lugs 30 on leading track retainers 27 and 31 extend outwardly in opposing directions. Similarly, lugs 30 on following track retainers 28 and 32 also extend outwardly in opposing directions. In the preferred embodiment, lugs 30 on leading retainer 27 and following retainer 28 extend in the same direction while lugs 30 on leading retainer 31 and following retainer 32 extend outwardly in the opposite direction. In this manner, when received within channel 23, leading track retainers 27 and 31 and following track retainers 28 and 32 will be securely held in place by way of opposed and outwardly extending lugs 30 being received and engaged beneath lip members 22. The width of lower track engaging means 26, as measured from opposing lugs 30, is greater than the width of channel 23, hence lugs 30 will engage beneath lip members 22 to hold roller 11 in place.

In order that lower track engaging means 26 can be releasably received within lower track 21, one of the leading track retainers 27 and 31 and one of the following track retainers 28 and 32 is flexibly resilient such that they may be displaced allowing the respective track retainers to be inserted or removed from lower track 21. When the flexibly resilient track retainers are displaced, lugs 30 are able to clear lip members 22. The other of the leading track retainers 27 and 31 and the other of the following track retainers 28 and 32 are rigid. Preferably, leading track retainer 31 and following track retainer 32 are flexibly resilient, whereas leading track retainer 27 and following track retainer 28 are rigid. That is, as shown in FIG. 5 the leading and following track retainers closest to roller 11 are preferably flexibly resilient, whereas the leading and following track retainers furthest from roller 11 are preferably rigid. This helps to protect flexible track retainers 31 and 32 from damage that may be caused by striking objects that may be in the path of roller 11. The two rigid track retainers 27 and 28 are able to withstand impacts with foreign objects and will help to clear such objects from track 21.

It will be noted that leading track retainers 27 and 31 and following track retainers 28 and 32 are fixed to roller housing 10 and protrude downwardly beyond the lower circumferential edge of roller 11. Accordingly, when sliding door 2 is removed from lower track 21 and stood upon a floor or surface, the entire weight of sliding door 2 will be borne fully by track retainers 27, 28, 31 and 32. Roller 11 does not come into contact with the floor or surface. Due to their rigidity, increased strength and ability to withstand greater compressive loading, most of the weight of sliding door 2 will be borne by rigid track retainers 27 and 28.

It will therefore be appreciated that track retainers 27, 28, 31 and 32 serve a variety of purposes. First, they provide a releasable means to securely hold roller 11 within lower track 21 thereby preventing the roller 11 from "jumping out" of lower track 21. Secondly, they provide a means to provide positive alignment of roller 11 within track 21 to ensure smooth operation of roller 11 and to prevent binding of the roller within the track. Thirdly, they provide a means to help clear debris from the track thereby also helping to ensure smooth operation of roller 11 and preventing damage to the roller. Finally, they also provide a means to support the entire weight of the door, with no weight borne by roller 11, when the door is removed from lower track 21 and leaned against a wall or surface with its bottom edge down. Leading and following track retainers 27, 28, 31 and 32 are preferably formed integrally with roller housing 10. In this manner the track retainers cannot be intentionally or inadvertently left off when assembling the door.

In the preferred embodiment roller housing 10 is comprised of a nylon compound having approximately 15 percent fibreglass fill for strength. To ensure smooth rolling, and also to provide adequate strength and abrasion resistance, roller 11 is preferably made from polyacetol.

It will therefore be understood that through the incorporation of a roller mechanism as described above, inserting leading track retainers 27 and 31 and following track retainers 28 and 32 into lower track 21 merely requires pushing roller housing 10 downwardly into track 21 until flexible track retainers 31 and 32 displace inwardly toward the middle of track 21 such that lugs 30 are able to clear lip members 22. To facilitate in the insertion of the track retainers as described, the lower surfaces of lugs 30 are slightly bevelled in an upward direction. This sloping or bevelling of lugs 30 assists in pushing them past lip members 22. In addition, as the track retainers are pushed downwardly, the bevelled surfaces of lugs 30 will actually impart a force on lugs 30 in i direction that is approximately perpendicular to the track retainers. This force will tend to deflect or displace flexible track retainers 31 and 32, allowing lugs 30 to slip past lip members 22. After flexible track retainers 31 and 32 have cleared lip members 22, they will "snap" back into place, securing lugs 30 under lip members 22 and thereby also securing roller 11 in channel 23.

Similarly, removal of sliding door 2 is equally simple in that a tradesman need only insert a screw driver or similar object between roller housing 10 and lower track 21 to displace track retainers 31 and 32 so that lugs 30 will clear lip members 22. Lower track engagement means 26 can then be removed from track 21.

It is to be understood that what has been described are the preferred embodiments of the invention and that it may be possible to make variations to these embodiments while staying within the broad scope of the invention. Some of these variations have been discussed while others will be readily apparent to those skilled in the art. For example, while adjustment screw 18 has been described as bearing against lower surface 19 of top 13, hole 20 through top 13 could equally be threaded and engagement screw 18 threadably received therein.

I claim:

1. A roller mechanism for a sliding door of the type having a door panel, a rectangular frame with rigid bottom, top and side members, and a lower track for receiving a roller, the roller mechanism comprising:

(i) a rigid bracket member to attach said roller mechanism to said sliding door;

(ii) a roller housing containing a roller, said roller housing being vertically adjustable within said bracket member, said roller being receivable within said lower track and facilitating the sliding movement of said door; and, (iii) lower track engaging means, said engaging means being releasably retained within said lower track and comprising a pair of leading and a pair of following track retainers, one of said leading and one of said following track retainers being rigid and capable of supporting said sliding door when said roller is removed from said lower track, the other of said leading and of said following track retainers being flexibly resilient such that they may be displaced to allow for the insertion and removal of said lower track engaging means into and out of said lower track.

2. The roller mechanism as claimed in claim 1 wherein said lower track engaging means, when releasably retained within said lower track, prevents the upward movement of said roller out of said lower track.

3. The roller mechanism as claimed in claim 2 wherein said roller, when received within said lower track, supports at least a portion of the weight of said door and transmits said weight to said track.

4. The roller mechanism as claimed in claim 3 wherein said leading and said following track retainers are fixed to said roller housing and protrude downwardly beyond the lower circumferential edge of said roller.

5. The roller mechanism as claimed in claim 4 wherein said sliding door is fully supported by only said leading and said following track retainers when said roller is removed from said lower track and said sliding door is stood on a surface, said roller not coming into contact with said surface when said door is fully supported by said leading and said following track retainers.

6. The roller mechanism as claimed in claim 5 wherein said sliding door is primarily supported by only said rigid leading and said rigid following track retainers when said door is stood on a surface.

7. The roller mechanism as claimed in claim 6 wherein each of said leading and said following track retainers comprises a hook-like member having an outwardly extending lug, said lugs engaging said lower track beneath overturned lip members on said lower track when said engaging means is retained within said lower track.

8. The roller mechanism as claimed in claim 7 wherein said lugs on said leading track retainers extend outwardly from said leading track retainers in opposing directions.

9. The roller mechanism as claimed in claim 8 wherein said lugs on said following track retainers extend outwardly from said following track retainers in opposing directions.

10. The roller mechanism as claimed in claim 9 wherein said roller is mounted on an axle, said axle being supported at both ends by said roller housing.

11. The roller mechanism as claimed in claim 10 wherein said roller housing is slidably received within said bracket member, said roller housing being vertically adjustable within said bracket member through the use of an adjustment screw.

12. The roller mechanism as claimed in claim 11 wherein said adjustment screw is wholly retained within said bracket member.

13. The roller mechanism as claimed in claim 10 wherein said leading and said following track retainers are formed integrally with said roller housing.

14. The roller mechanism a claimed in claim 13 wherein said roller is retained substantially within said roller housing, said roller housing protecting said roller from damage.

15. The roller mechanism as claimed in claim 14 wherein the two innermost of said leading and said following track retainers are flexibly resilient.

16. The roller mechanism as claimed in claim 15 wherein the two outermost of said leading and said following track retainers are rigid.

17. The roller mechanism as claimed in claim 16 including bearing means to facilitate the rotation of said roller about said axle.

* * * * *